US007782199B2

(12) United States Patent
Issokson

(10) Patent No.: US 7,782,199 B2
(45) Date of Patent: Aug. 24, 2010

(54) PORTABLE SELF-CONTAINED ALARM SYSTEM

(76) Inventor: Michael Issokson, 518 Holly La., Duncanville, TX (US) 75116

( * ) Notice: Subject to any disclaimer, the term of this patent is extended or adjusted under 35 U.S.C. 154(b) by 339 days.

(21) Appl. No.: 12/124,930

(22) Filed: May 21, 2008

(65) Prior Publication Data

US 2009/0289790 A1 Nov. 26, 2009

(51) Int. Cl.
*G08B 21/00* (2006.01)

(52) U.S. Cl. ..... 340/541; 340/545.3; 340/565

(58) Field of Classification Search ..... 340/541, 340/552, 539.26, 539.31, 540, 546, 545.2, 340/545.3, 551, 553, 561, 565, 566, 567, 340/693.5

See application file for complete search history.

(56) References Cited

U.S. PATENT DOCUMENTS 6,118,375 A * 9/2000 Duncan ..... 340/541
6,441,731 B1 * 8/2002 Hess ..... 340/539.26
6,650,239 B1 * 11/2003 Hron ..... 340/541
7,411,496 B2 * 8/2008 Sharpe ..... 340/540

* cited by examiner

*Primary Examiner*—Toan N Pham
(74) *Attorney, Agent, or Firm*—Donald W. Meeker

(57) ABSTRACT

A secure sealed container and mounting pole house any of a variety of security equipment. Sensing equipment, a high decibel siren, and strobes simulating police lights are removably attachable to a universal mount and control circuit. A control panel connected to the circuit enables and disables the alarm, and monitors system activity.

7 Claims, 2 Drawing Sheets

PORTABLE SELF-CONTAINED ALARM SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to alarm systems and in particular to a mobile self-contained security system transportable to remote locations for securing the location against theft or other intrusions, the system comprising a secure sealed container weighted at the bottom to anchor it and a securely attached mounting pole with universal mounting bases to receive any of a variety of security equipment to fit the needs of the location including sensing equipment to detect and visually record intruders and notify a remote location of the intrusion, a variety of alarms including a high decibel siren and strobes simulating police lights.

2. Description of Related Art Including Information Disclosed Under 37 CFR 1.97 and 1.98

New construction theft is at an all time high. Builders are continuously being frustrated by theft of their construction materials. Prior art devices do not adequately provide secure systems which are mobile and self-contained adapted with any necessary security devices to secure individual remote locations.

U.S. Pat. No. 5,117,223 for a combination portable alarm system and storage container for parts thereof discloses a portable alarm system for a construction site or the like which is provided with and consists of a cabinet, a stanchion supported on the cabinet, an alarm unit supported on the stanchion, and a key pad to program the alarm unit.

U.S. Pat. No. 5,463,595 for a portable security system for outdoor sites discloses a security system suitable for use in monitoring property at an outdoor site, that includes a portable housing which supports a motion detector for sensing motion within a detection zone.

U.S. Pat. No. 4,943,799 for a portable alarm system with sealed enclosure discloses a portable alarm system which includes a compact portable sealed housing having an electronic alarm control circuit therein, as well as external detectors.

U.S. Pat. No. 5,117,223 for a combination portable alarm system and storage container for parts thereof is for a portable alarm system for a construction site or the like with a cabinet, a stanchion supported on the cabinet, an alarm unit supported on the stanchion, and a key pad to program the alarm unit. When not in use the stanchion and alarm unit are stored within the cabinet.

U.S. Pat. No. 5,463,595 for a portable security system for outdoor sites comprises a security system (10) suitable for use in monitoring property at an outdoor site that includes a portable housing (12) that supports a motion detector (14) for sensing motion within a detection zone. The security system further includes an ultrasonic transducer (74) and several alarm generators capable of repelling a human intruder, including a high intensity illumination source (18), high decibel siren (82), strobe light (19), and a speaker (78) for transmitting a prerecorded message. When an intrusion is initially detected by the motion detector, the ultrasonic transducer is activated to emit an ultrasonic signal that is irritating to nonhuman animals, thus clearing the detection zone of nonhuman intruders. If after sounding of the ultrasonic transducer motion is still detected, one or more of the alarms is activated. Additionally, an automatic telephone dialer (86) may be included in the system and activated by the system as another type of alarm, in response to detected intrusion. The system is integrated within the portable housing and is resistant to false alarms, making it suitable for use in monitoring property stored at an outside site. A method for utilizing the security system to protect property is also disclosed.

U.S. Pat. No. 4,943,799 provides a portable alarm system with sealed enclosure which includes a compact portable sealed housing having an electronic alarm control circuit therein. An electrical AC cord supplies power to the control circuit and plugs into the housing. A telephone jack connects a telephone circuit to a dialer circuit within the control circuit. A digital key pad is secured to the housing and has a plurality of switches actuable exteriorly of the housing whereby to program the control circuit by a lessor person and for actuating or deactuating the control circuit by a lessee user person. A receiver circuit is also provided in the housing and is connected to the control circuit. One or more wireless infrared detectors are detachably secured to the housing and positioned to detect moving objects within an environment to be protected. The detectors have infrared transmitters, of different frequencies, and transmit alarm signals to the receiver. The receiver has a first channel which is responsive to a first detector and is connected to the control circuit through a delay circuit so that the control circuit only switches to an alarm state to generate an alarm code on the telephone line after a predetermined time delay. The second channel of the receiver has no delay circuit. A siren is connected to the control circuit and secured to the housing to generate an audible local alarm upon activation of the control circuit to the alarm state.

U.S. Pat. No. 6,154,130 for a portable room security system is for use in hotel rooms, apartments, vehicles having sleeping areas (such as motor homes, RV's, trailers, etc.) and the like. The system integrates into a single housing a smoke detector and a movement sensor, both serially connected to an audio alarm and a visual alert. The system further includes a magnetically isolated slot for holding hotel key cards, as well as a series of hooks for holding several key rings. Also available is a bracket mounted to the housing for holding a flashlight. The system is optionally operated using a remote control device, and may include circuitry enabling automatic telephone dialing to alert outside assistance in the event of an alarm. Two types of structure may be used to suspend the device from an associated door. The first is a pliable extension bar and hook which suspends the device from a door knob. The second is a bracket extension piece enabling the device to be hung from the top of a door. This version is particularly useful to prevent small children from altering the settings.

U.S. Pat. No. 6,049,274 for a portable security system includes a control circuit 12 electrically connected with a motion sensor 14, an audible alarm 16 and a visual alarm 18. These components are held within a housing 20 which has a standard light globe/tube electrical connector 22 attached to one end 24 for allowing connection to mains power through a corresponding standard light globe/tube socket. A standard light globe 26 is demountably connected within the housing 20 to illuminate an area in the same manner as if the globe 26 were connected directly into the socket which receives the connector 22. A portable remote controller 28 switches the control circuit 12 between an ON state in which the control circuit is active to operate the audible and visual alarms 16, 18 upon detection of a moving body by the motion detector 14; and, an OFF state in which the control circuit deactivates the motion sensor 14 and allows the light globe 26 to be operated as a standard light globe by the switch for the socket to which the connector 22 is connected. Thus, the system 10 can be simply installed in an conventional light socket.

U.S. Pat. No. 5,587,700 for a portable security alarm unit is made up of a housing component containing control electronics, powered by an external power source, a back-up battery connected to the control electronics and wiring that connects the control electronics and/or battery to external accessories such as motion sensors, a siren, a temperature sensor and to a motion sensor and keyboard built into the frontally located walling of the housing component. There is also a slidable panel component that slides on tracks built into extensions of the roofing and flooring of the housing component such that the slidable panel component is capable of covering completely at any one time either the keyboard or motion sensor both of which are built in adjacent one another into the frontally located walling of the instant device's housing component.

U.S. Pat. No. 6,864,789 for a personal property security device monitors personal property using a wireless interface to a communication network is presented. The device is comprised of a security module that interfaces with a wireless transceiver such as a cellular telephone. The security module includes a detection monitor the alarms upon a condition and initiates a dialing command to the wireless telephone. The wireless telephone includes a preprogrammed number of a user and is readily reprogrammable to other numbers. Once the communication link is established, the user may listen to the audible conditions around the security device and determine the legitimacy of the alarm. Optional enhanced interrogation of the security device is also contemplated. The security device further includes a location identifier, an example of which is a tracking transmitter that emits a beacon signal for tracking by the user or others.

U.S. Pat. No. 6,650,239 for an outdoor intrusion detection alarm includes a portable housing (1), a plurality of adjustable fasteners (21) and (22), an augmented switch (5), and a sensor line (3) for sensing human and/or animal intrusions into a predetermined perimeter or boundary configuration, which can be variable in conformity with terrain and flora. A battery powered high decibel piezo siren (7) activates when any intrusion occurs. The sensor line is released, retrieved, and stored on a reel that is an integral part of the housing, completing a lightweight alarm system that fits in a coat pocket or backpack pouch of a camper, hiker, or soldier. The system can also be used for protecting gardens and fruit trees, automobile and airplane displays, and comparable things.

U.S. Pat. No. 6,181,244 for a construction site portable monitoring system is for use at sites, such as construction sites. The portable monitoring system can provide enhanced security at such sites and may be quickly set up and taken down. A portable monitoring system, in accordance with one embodiment of the invention, includes a housing and a plurality of portable sensing devices and a plurality of mounting platforms both capable of being removably stored in the housing. The mounting platforms may be easily retrieved from the housing and disposed about the site and are each capable of detachably mounting one or more of the portable sensing devices. The portable sensing devices each include a sensor for sensing a stimulus and a transmitter, coupled to the sensor, for transmitting a signal associated with the stimulus. The housing further includes a communication system for receiving the transmitted signals from each of the portable sensing devices and communicating signals associated with the sensed stimuli to an external system.

U.S. Pat. No. 6,288,642 for a self-contained security system comprises at least one satellite unit coupled in signal communication to a main unit, the main unit for emitting an alerting stimulus in response to a signal received from the satellite unit indicating the presence of a security threat.

U.S. Pat. No. 5,565,844 for an intrusion detector employs a remote, 360 degree infrared detector. The system includes a base unit with a receiver, controller, and phone jack, a remote sensor which is adjustable along a vertical axis and includes a 360.degree. infrared motion sensor, and a central monitoring station in communication with the base unit via a telephone network. The remote sensor may be selectively positioned to detect movement in a surrounding area definable by the user. The base unit may be programmed to contact the monitoring station when the sensor detects motion, and also to receive test signals from the monitoring station and verify that the system is operational.

U.S. Pat. No. 4,742,336 for a portable intrusion detection warning system is housed in a portable carrying case in the configuration of a briefcase with handle for convenient portability and inconspicuous placement at a desired location near a space to be monitored. Intrusion detectors are removed from the carrying case and placed in the space to be monitored. The intrusion detectors may include infrared motion sensors and radio transmitters for transmitting detection signals to a radio receiver in the carrying case. An electronic controller receives the detection signals from the radio receiver and delivers actuating data signals to a digital communicator and digital dialer with a telephone line output. The digital communicator captures a telephone line with dialing signals and sends further coded signals corresponding to different monitored spaces and intrusion detectors from which detection signals are received. The electronic controller includes an arming circuit and key switch for arming and disarming the monitoring and warning system. The external power supply plug, telephone jack and key switch are mounted on the carrying case so that the components are operable from outside the carrying case with the intrusion detectors in place and the briefcase configuration carrying case closed and locked. Internal battery standby power supply is also provided.

U.S. Pat. No. 4,151,520 for a portable self-contained alarm with remote triggering capability comprises a portable housing having an audio alarm positioned therein and a battery powered electronic circuit for activating the alarm. The circuit comprises a battery, an arming switch, a triggering switch, an audio alarm, and a latching circuit and oscillator circuit utilizing an integrated circuit therein. The circuit also includes a means for connecting auxiliary devices thereto and a means for coupling an AC adapter. A magnetically operated reed switch and a mechanically operated pull switch comprise the normally open triggering switch. The triggering switch also contains means for adapting any activator wired normally open to the triggering switch. The oscillator circuit drives the audio alarm whenever any of the triggering switches are closed and the latching circuit maintains the oscillator in an operating mode.

U.S. Pat. No. 4,319,228 for a portable intrusion alarm is provided in a compact enclosure permitting its movement from location to location as needed. The alarm includes one or more motion detectors, some of which may be battery operated, one or more alarm devices, such as sirens, strobe lights, and remote etc., door switches and appropriate relays for operating the system. A battery back up system insures that the alarm is always activated.

U.S. Pat. No. 5,587,701 for a portable alarm system is disclosed in which the alarm functions are contained within a portable enclosure, communication is maintained between the enclosure and wireless security contacts placed at points of entry, and the alarm is capable of initiating a telephone call to a security monitor station either by conventional hard wired telephone lines within a building, or by cellular transmission, or via 800 MHz trunking.

What is needed is a mobile self-contained security system transportable to remote locations for securing the location against theft or other intrusions, the system comprising a secure sealed container weighted at the bottom to anchor it and a securely attached mounting pole with universal mounting bases to receive any of a variety of security equipment to fit the needs of the location including sensing equipment to detect and visually record intruders and notify a remote location of the intrusion, a variety of alarms including a high decibel siren and strobes simulating police lights.

BRIEF SUMMARY OF THE INVENTION

An object of the present invention is to provide a mobile self-contained security system transportable to remote locations for securing the location against theft or other intrusions, the system comprising a rugged secure sealed container capable of withstanding the demanding environment of a construction site weighted at the bottom to anchor it and a securely attached mounting pole with universal mounting bases to receive any of a variety of security equipment to fit the needs of the location including sensing equipment to detect and visually record intruders and notify a remote location of the intrusion, a variety of alarms including a high decibel siren and strobes simulating police lights.

Another object of the present invention is to provide a tamperproof, waterproof, sealed container and mounting pole.

In brief, a mobile, reusable housing and mounting platform for the use of security products/devices and services those items can provide. This product would allow the items contained within to work outside the normal parameters they were originally designed for. For example, home security systems are traditionally designed to be installed in a home or business. However, by installing them within this housing, they could be used to protect houses while under construction (i.e. as a jobsite deterrent system). Likewise, cameras and a digital video recorder could be added to create a mobile video device. While the invention is intended primarily as a job site deterrent system, this product can be used in many applications. Such as guard tour check in stations. Several units can be set up on a single site to ensure the guard is making their tours as scheduled failing to checking in at one of the stations could call the monitoring center and report the missed round.

An advantage of the present invention is that it provides a portability for use in construction job sites and other sites that would need a temporary security system that is rugged and yet substantial enough in size to withstand the demanding environment of a construction site.

Another advantage of the present invention is that it provides not only a wired power supply, but a large capacity backup battery in the base for supplying power to the security system for up to one week if the wired power supply is lost An added advantage of the present invention is that it provides additional security add-ons to the basic system using the mounting pole, such as video and audio monitoring.

An extra advantage of the present invention is the ability to a wirelessly link multiple units together to add greater coverage and simplified operation to larger projects.

A further advantage of the present invention is that it provides a high decibel siren and red and blue strobes simulating police lights to deter theft and other suspicious activity.

A supplementary advantage of the present invention is the ability to connect to the job-sites existing hardwired window and door sensors via a wireless connection module adding to the systems overall perimeter intrusion detection capabilities One more advantage of the present invention is that it provides a compact, self-contained mobile security system for monitoring and recording activity, and reporting intrusions at unsecured unoccupied locations to deter theft and other crimes.

An additional advantage of the present invention is that it provides a system that is tamper proof and waterproof.

BRIEF DESCRIPTION OF THE SEVERAL VIEWS OF THE DRAWINGS

These and other details of the present invention will be described in connection with the accompanying drawings, which are furnished only by way of illustration and not in limitation of the invention, and in which drawings.

DETAILED DESCRIPTION OF THE INVENTION

Figure 1:
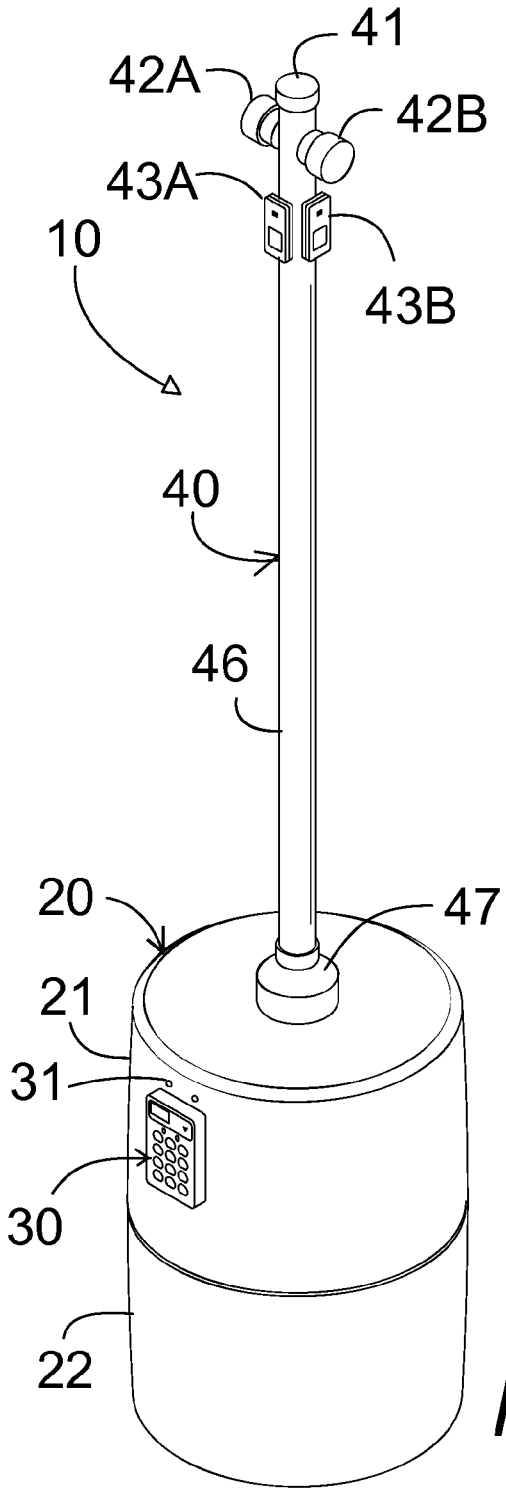
FIG. 1 is a perspective view showing the compact, self-contained mobile security system of the present invention.
Figure 2:
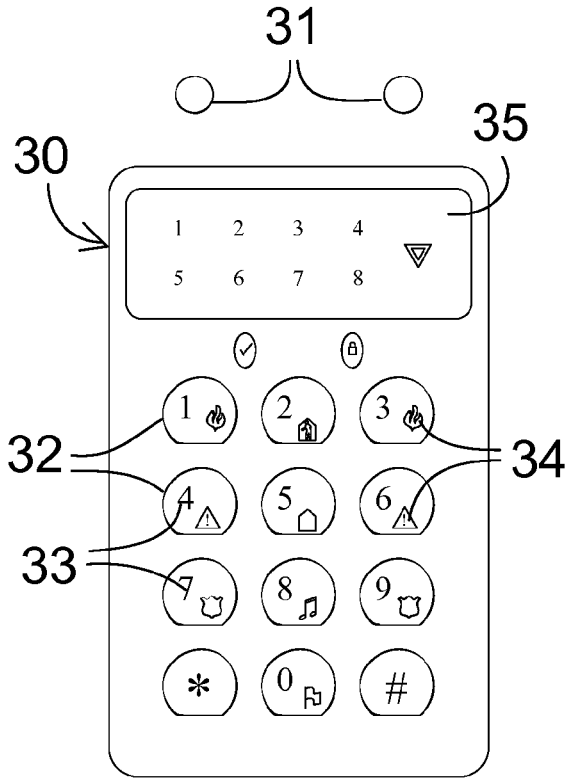
FIG. 2 is a perspective view showing the control panel for the system of FIG. 1 showing the keypad and digital readout window.
Figure 3:
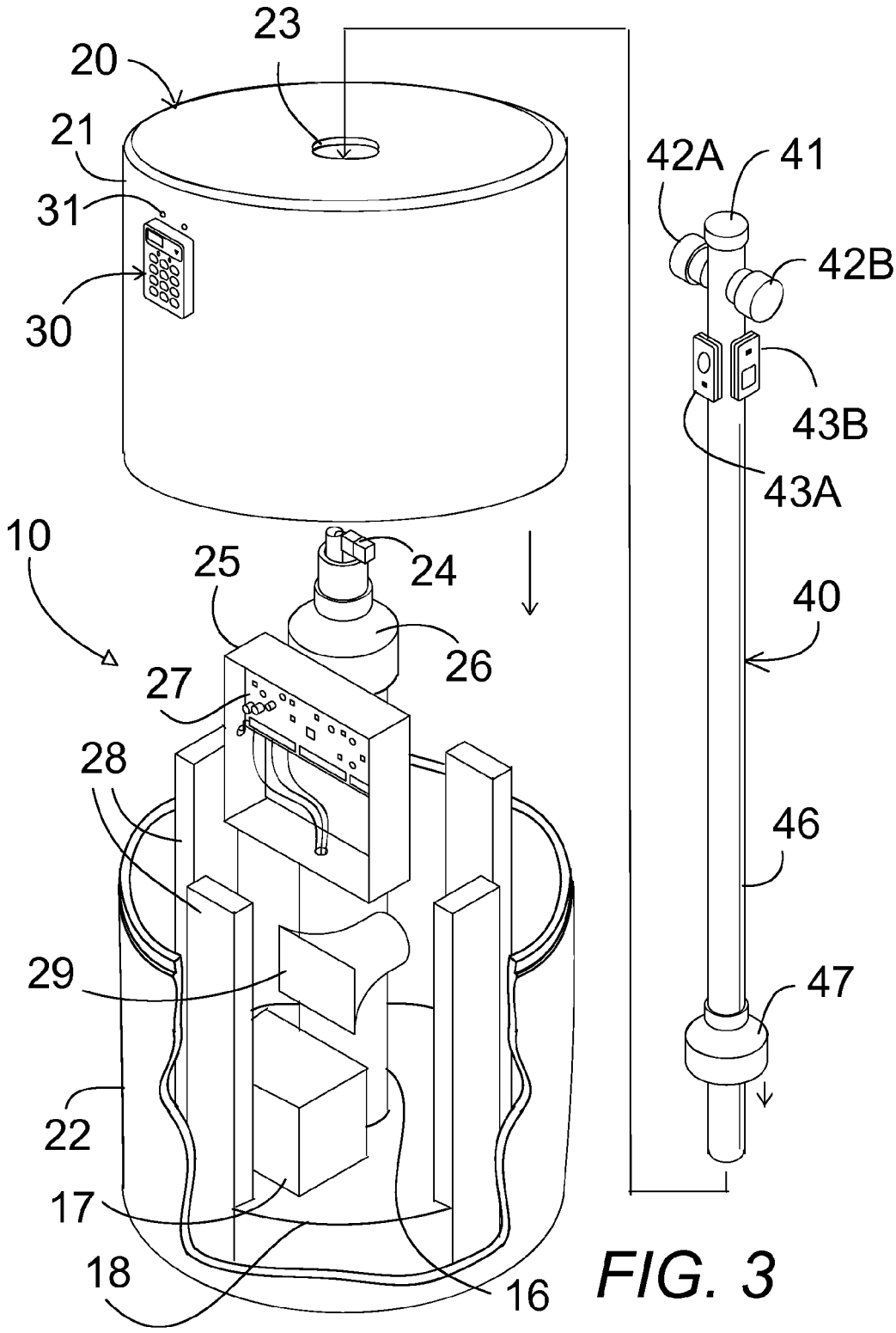
FIG. 3 is an exploded partially broken perspective view of the system of FIG. 1 showing the components aligned for assembly.

In FIGS. 1-3, a compact, self-contained mobile security system 10 for monitoring and recording activity, and reporting intrusions at unsecured, unoccupied locations to deter theft and other crimes comprises a barrel-shaped reusable mobile container 20 with a center mounting pole 40 for removably installing any of a variety of security devices.

In FIGS. 1 & 3, the reusable mobile container 20 comprises an enclosed housing fabricated of shock resistant waterproof material having a bottom portion 22 for resting on a horizontal external surface, a top portion 21 covering an opening for accessing the interior of the container for installing and removing any of a variety of security devices in the container, and a series of support poles 28 around the interior. The top portion 21 seals closed on the bottom portion, and a rigid mounting pole 40 with a cap 41 at the top extends upwardly through a sealed pole opening 23 in the top portion, the sealed connector 47 for the pole connecting to the quick connect harness 26 in the base, to form a sealed tamperproof, waterproof container 20 and mounting pole 40.

In FIG. 3, a weighted ballast 18 of poured concrete is contained in a bottom portion of the mobile container 20 for maintaining the portable container in an upright position. A mounting platform 16 is attached to the interior of the transportable container to support the mounting pole 40 formed from PVC pipe that can receive any of a variety of security devices attached thereto. An electronic control circuit board 27 is also housed within the sealed transportable container 20 to which all of the security devices are connected electrically.

In FIGS. 1-3, a control panel with keypad 30 is attached to the exterior of the portable container 20, the control panel 30 communicates with the electronic control circuit 27 to control a series of security devices electrically communicating with the electronic control circuit. The control panel 30 is programmed to receive a security code by an authorized user to deactivate the security system during authorized use of the location and to activate the security system for securing the location when not in authorized use. In FIG. 2, the control panel comprises status indicator lights 31 to indicate if the system is activated or not, a readout area 35, and keys 30 that feature both numbers 33 and symbols 34.

In FIGS. 1 & 3, the security system 10 accommodates a plurality of security devices attached to the mounting platform 16 and the mounting pole 40 which electrically communicate with the electronic control circuit 27 housed in the control circuit box 25. The security devices comprise at least one security device, and can include a 122 db ear piercing siren 29 housed within the transportable container for sound notification of intrusion and deterrence, at least one high luminance strobe light 42A & B attached to a top portion of the mounting post for visual notification of intrusion and deterrence, a voice module 43A for recording voices and sound and broadcasting voices and sound for sound monitoring and deterrence, any of a variety of motion detection devices 43B including passive infrared devices and microwave devices and any of a variety of camera recording devices mounted on the mounting pole 40 for 360 degree visual monitoring and recording and transmission to at least one remote location, and a communication device for dispatching personnel to the location from a remote location. The system 10 further comprises an auxiliary connection used on sites that are pre-wired for alarm systems in buildings to enable the arming of doors and windows once they have been installed.

In FIG. 3, the security system 10 is powered by a wired power supply connection for powering all components of the system and a large capacity backup battery 17 housed in the bottom 22 of the mobile container 20 for supplying power to the security system for up to one week if the wired power supply is lost.

FIGS. 1 & 3 show at least one high luminance strobe 42A & B preferably comprising a red strobe and a blue strobe to simulate police strobe lights is mounted to the pole 40.

FIG. 3 shows the electronic control circuit board 27 connected to a universal wiring harness 24 for electrically connecting the plurality of security devices.

In use, at a remote location, such as a construction site, after a building has been framed, and the portable security system 10 of the present invention is armed and put into place on the job site, the system of the present invention will then begin deterring intruders. The present invention may comprise a 4-camera job-site security device with recording, monitoring, intrusion detection and alarm sensing capabilities 43A & B mounted on a 7-foot pole 40 and installed on a remote site. It will detect their presence and sound an ear-piercing 122 db siren 29 and flash high luminance red and blue strobes 42 A & B to discourage intruders from committing crimes on the property. An LCD keypad 30, supplied for all units at a development site, plugs into a front of the present invention and can be used to track all the times the device was triggered and set off alarms and can be used to track all the times the device was armed and disarmed and with which code. When the communication feature is activated the customer can receive notification of alarms, trouble signals, when and by who armed or disarmed the system by a phone call from the monitoring center personnel, a text message or an e-mail. The present invention can be disarmed during construction times and re-armed after sub-contractors have left for the day. The system can be programmed to auto-arm at a predetermined time so if a contractor forgets to arm the system upon leaving the job-site, it limits the exposure of the site to theft. After doors and windows are installed, the present invention can connect to the pre-wired alarm system contacts in the structure to arm them as well. Options are also available for voice module, camera, recording devices, wireless devices and dispatched center monitoring, as well.

A wired power supply connection powers all components of the system and a large capacity backup battery 17 supplies power for up to one week if ac power is lost.

The system 10 thereby forms a compact, yet substantial and rugged self-contained mobile security system for monitoring and recording activity, and reporting intrusions at unsecured unoccupied locations to deter theft and other crimes.

It is understood that the preceding description is given merely by way of illustration and not in limitation of the invention and that various modifications may be made thereto without departing from the spirit of the invention as claimed.

What is claimed is:

1. A compact, self-contained mobile security system for monitoring and recording activity, and reporting intrusions at unsecured unoccupied locations to deter theft and other crimes, the system comprising:

a reusable mobile container transported to a location to provide security to the location, the container comprising an enclosed housing fabricated of shock resistant waterproof material having a bottom portion for resting on a horizontal external surface, and a top portion covering an opening for accessing an interior of the container for installing and removing any of a variety of security devices in the container, the top portion sealed closed on the bottom portion, and a rigid mounting pole extending upwardly through a sealed pole opening in the top portion to form a sealed tamperproof container and mounting pole;

a weighted ballast in a bottom portion of the mobile container for maintaining the mobile container in an upright position;

a mounting platform attached to an interior of the mobile container for receiving any of a variety of mounting platform security devices attached thereto;

an electronic control circuit housed within the sealed tamperproof container;

a control panel having a keypad attached to an exterior of the mobile container, the control panel communicating with the electronic control circuit to control the electronic circuit and a series of control panel security devices electrically communicating with the electronic control circuit, the control panel programmed to receive a security code by an authorized user to deactivate a security system during authorized use of a location and to activate the security system for securing the location when not in authorized use;

the variety of mounting platform security devices, attached to the mounting platform and the mounting pole and electrically communicating with the electronic control circuit, the comprising at least one security device taken from a list of mounting platform security devices including a siren housed within the mobile container for sound notification of intrusion and deterrence, at least one high luminance strobe light attached to a top portion of the mounting pole for visual notification of intrusion and deterrence, a voice module for recording voices and sound and broadcasting voices and sound for sound monitoring and deterrence, any of a variety of camera recording devices mounted on the mounting pole for 360 degree visual monitoring and recording and transmission to at least one remote location, a communication device for dispatching personnel to the location from a remote location, any of a variety of motion detection devices including passive infrared devices and microwave devices mounted on the mounting pole for 360 degree coverage for detection of intrusion;

a wired power supply connection for powering all components of the security system and a large capacity backup battery for supplying power to the security system for up to one week if the wired power supply is lost;

thereby forming the compact, self-contained mobile security system for monitoring and recording activity, and reporting intrusions at unsecured unoccupied locations to deter theft and other crimes.

2. The system of claim 1 wherein the at least one high luminance strobe comprises a red strobe and a blue strobe to simulate police strobe lights.

3. The system of claim 1 wherein the electronic control circuit is connected to a universal wiring harness for electrically connecting the variety of mounting security devices.

4. The system of claim 1 further comprising a quick connect harness for the mounting pole.

5. The system of claim 1 wherein the weighted ballast comprises poured concrete in the bottom of the mobile container.

6. The system of claim 1 wherein the siren comprises a 122 db ear piercing siren.

7. The system of claim 1 further comprising an auxiliary connection used on sites that are pre-wired for alarm systems in buildings to enable arming of doors and windows once they have been installed.

* * * * *